United States Patent [19]

Conville et al.

[11] 3,982,237

[45] Sept. 21, 1976

[54] COMBINATION DOOR CHIME AND PARTICULATE PRODUCTS OF COMBUSTION DETECTOR

[75] Inventors: David J. Conville, Libertyville; Burke J. Crane, Lombard, both of Ill.

[73] Assignee: Rixson-Firemark, Inc., Franklin Park, Ill.

[22] Filed: Feb. 28, 1975

[21] Appl. No.: 553,907

[52] U.S. Cl. ..... 340/237.5; 250/239; 340/274 R; 340/392

[51] Int. Cl.[2] ..... G08B 17/10

[58] Field of Search ..... 340/237.5, 228.5, 274 R, 340/392, 396; 250/239, 574

[56] References Cited

UNITED STATES PATENTS

| | | | |
|---|---|---|---|
| 2,946,905 | 7/1960 | Jolly | 340/392 X |
| 3,530,455 | 9/1970 | Ressler | 340/274 |

FOREIGN PATENTS OR APPLICATIONS

| | | | |
|---|---|---|---|
| 831,812 | 3/1960 | United Kingdom | 340/237.5 |

*Primary Examiner*—John W. Caldwell
*Assistant Examiner*—Daniel Myer

[57] ABSTRACT

A combination door chime and detector responsive to the particulate products of combustion passing through multiple passageways formed in the chime cover. The door chime includes conventional spaced tone bars each cooperating with a tuned resonator chamber. A tone bar striker mechanism capable of single-note, two-note, and sustained-repetitive note striking of the tone bars is disposed between the tone bars. A photoelectric particulate products of combustion detector is also disposed between the tone bars. The conventional low-voltage door and chime transformer serves as a power supply for both the combustion detector and the striker mechanism. The closing of a first remote door chime switch generates a single-note signal; the closing of a second remote door chime switch generates a two-note signal; and the detection of the particulate products of combustion generates a sustained-repetitive note which serves as an intense audible alarm. An optional voltage comparator and signal gate serves to generate a pulsing repetitive signal with a relative large time interval between successive pulses. This fourth signal indicates a malfunctioning of the particulate products of combustion detector.

9 Claims, 13 Drawing Figures

COMBINATION DOOR CHIME AND PARTICULATE PRODUCTS OF COMBUSTION DETECTOR

BACKGROUND OF THE INVENTION

1. Field of the Invention

This invention relates to life safety, and in particular to detectors and alarms for the particulate products of combustion. The invention comprises a combination door-chime/smokedetector which may be advantageously located within non-industrial buildings, particularly of the residential type.

Within recent years, many ordinances, codes and standards have been promulgated which now require some form of smoke detection device in one or two family homes, apartments, and in some instances mobile homes. Many additional such codes and standards are pending as of this date and it is contemplated that within a few years the requirement for smoke detection devices suitable for non-industrial applications, such as homes and apartments, will be almost universal.

2. Description of the Prior Art

The prior art is prolific in smoke detection devices which are suitable for installation in non-industrial buildings. These devices in most instances employ ionization or photoelectric type smoke detectors, and accordingly, the location of such devices for reliable early warning generally requires the installation of electrical conduits carrying the necessary wiring to a location which does not have an appropriate power outlet. In existing construction, the cost and inconvenience of installing such conduit, as well as the poor appearance of exposed conduit, in many instances results in a decision not to install a smoke detection and alarm system.

Other smoke detectors suitable for installation in homes and apartments employ local battery power supplies. These devices are satisfactory when the batteries are new. However, in almost all instances the batteries must be replaced or recharged periodically due to the fact that there is a constant electrical load on the batteries because the detector must be continuously energized. Additionally, with certain of these devices, power supply output adjustments must be made periodically to compensate for the declining output voltage of the battery supply. In some cases, human oversight may result in smoke detectors of the battery type being relatively ineffectual due to the fact that the necessary power supply adjustments or battery replacements are not made as required.

While the cost for most residential smoke detector and alarm systems is not prohibitive, some contractors and home owners will not have such systems installed even in new construction due to the added expense.

SUMMARY OF THE INVENTION

Almost every home and apartment has a door chime which is energized by a low-voltage transformer which has a primary winding that is continuously energized. Additionally, many of these door chimes include a pair of tone bars which generate one-note or two-note signals to indicate the presence of an individual at back and front entrances to the home or apartment.

The smoke detector and alarm of the present invention contemplates using the typical door chime transformer as a power supply and the inherent capability of dual tone bars to create an intense audible alarm signal if repetitively struck. In existing installations, space is usually available within the door chime housing to include a smoke detector which is operative at the low voltage of the secondary winding of the door chime transformer. Additionally, space is generally available to install a striker mechanism which is capable of sustained repetitive striking of the two tone bars. If such is the case, the cost of retrofitting, as well as the inconvenience involved, in altering an existing door chime to include a smoke detector and alarm function is minimal. The power source and the lines leading from the power source to the door chime are already installed. Additionally, a mechanism for generating an audible alarm signal can be provided with minor modifications. Accordingly, a minimal installation inconvenience is incurred.

As an added factor in existing installations, door chimes are usually installed in central areas, such as a vestibule or common corridor, leading into bedrooms. This location is a satisfactory location for the installation of a central smoke detector and alarm. Accordingly, the existing door chime location can be employed without requiring relocation of the chime. In view of the fact that the power source to the chime is continuously energized, the unreliability that results from battery powered smoke detectors is not present. Moreover, the tone bars existing in door chimes, if repetitively struck at a high frequency, are capable of generating a substantially louder alarm signal than many relatively simple smoke detectors and alarms designed for home or apartment installations.

With respect to installations in new construction, a combination door chime/smoke detector of this invention involves substantially no added inconvenience or cost. Almost every house has a door chime and the door chime is energized by a low voltage transformer. Accordingly, a door chime incorporating the additional smoke detector and repetitive striker mechanism of this invention can be installed in approximately the same area in which a door chime is usually found at substantially no increase in cost or inconvenience to the contractor or home owner. As a result, the smoke detector and alarm of the present invention should find substantially acceptance because of the foregoing outlined advantages.

DETAILED DESCRIPTION OF THE DRAWINGS

In order that all of the structural features for attaining the objects of the invention may be readily understood, a detailed description appears hereafter, making reference to the following drawings wherein.

Figures 8, 13:
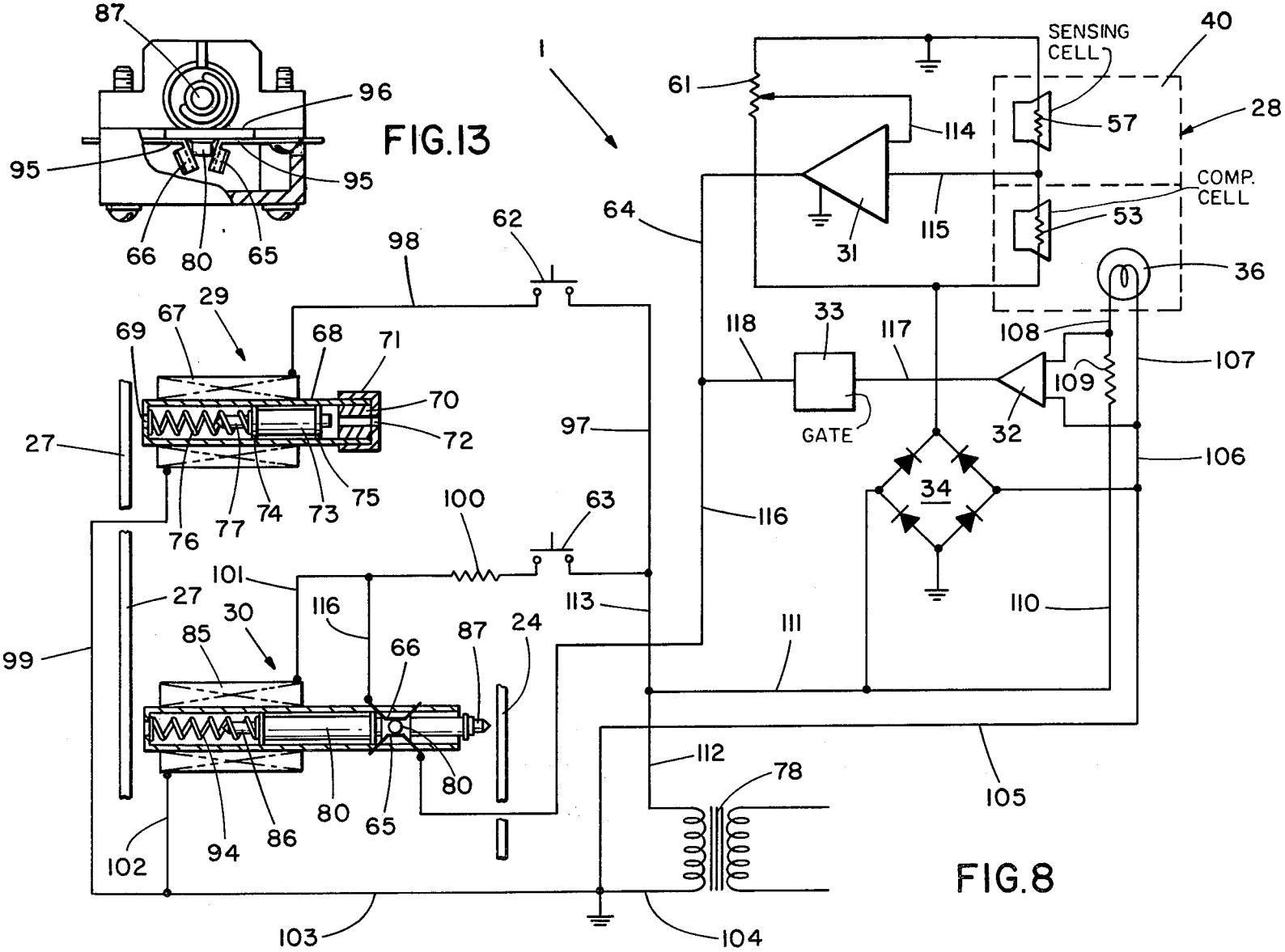
FIG. 8 is a schematic circuit diagram showing the interconnection of the various electrical components of the door chime/smoke detector of this invention.
Figure 9:
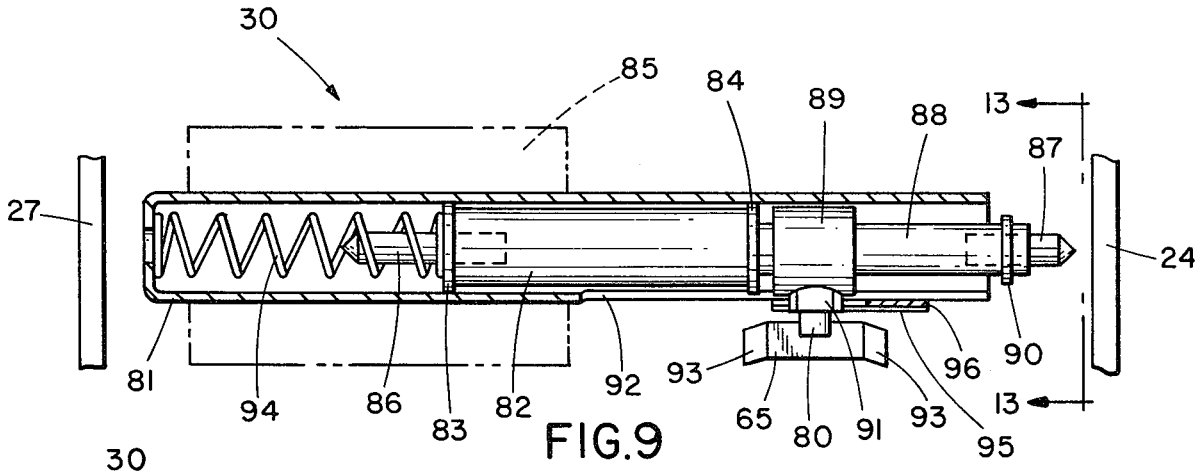

FIGS. 9 through 12 inclusive are sequential views showing the operation of the two-note and the sustained signal striker mechanism during the reciprocating strokes of the striker plunger;

FIG. 13 is an enlarged view of the switching mechanism taken along line 13—13 of FIG. 9.

DETAILED DESCRIPTION OF THE PREFERRED EMBODIMENT

Figure 1:
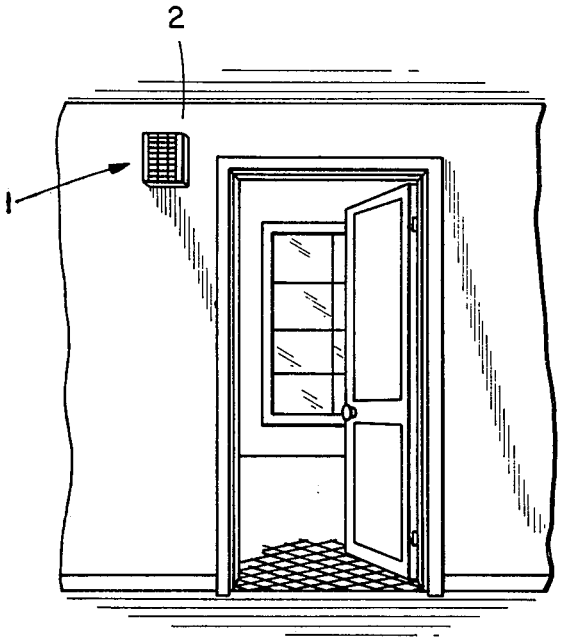
FIG. 1 is a view showing the wall mounted door chime/smoke detector of this invention.

Referring now to FIG. 1, the condition-responsive door chime of this invention is shown typically applied to a vertical wall 2. In view of the fact that chime 1 contains a particulate products of combustion detector (hereafteer called a smoke detector), the optimum location of the chime to effect an early alarm in response to a smoke condition is generally determined in accordance with principles of smoke flow which are applicable to life safety. Quite obviously, chime 1 should not be located in any "dead air spaces", and additionally, it should not be located in remote areas or at room levels which will require a substantial period of time before the arrival of smoke.

Figure 2:
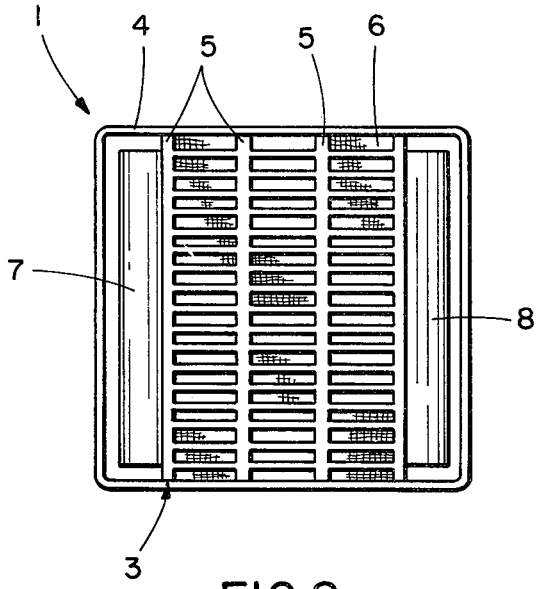
FIG. 2 is an enlarged front view of the door chime/smoke detector of FIG. 1.

A typical cover 3 for chime 1 is shown in FIG. 2. Covers for door chimes may be obtained in almost infinite decors. The essential requirement in the present application is that the chime cover be porous to smoke.

With respect to cover 3 shown in FIG. 2, a rectangular frame 4 supports on its front a metallic grid 5 which defines a plurality of rectangular openings 6. These openings are covered by a suitable smoke porous fabric which will obscure the internal mechanism of chime 1, but at the same time enable smoke to enter into the front of cover 3. Additionally, cover 3 does not obscure tuned resonator chambers 7 and 8. Accordingly, smoke can enter into the interior of chime 1 through access openings surrounding resonator chambers 7 and 8. Frame 4 should also be formed with openings (not shown) which permit the easy flow of smoke into the interior of the chime.

Figure 3:
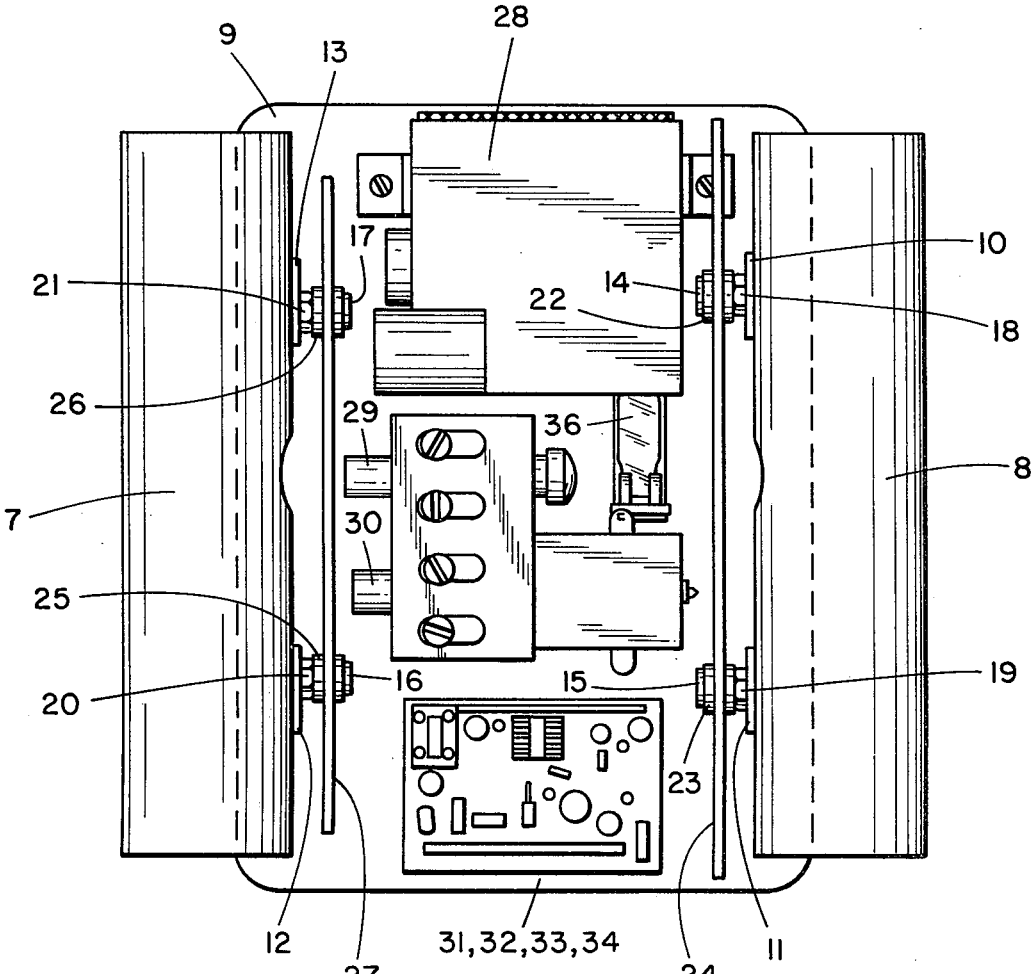
FIG. 3 is a front view of the door chime/smoke detector of the prior figures with the chime cover removed.
Figure 4:
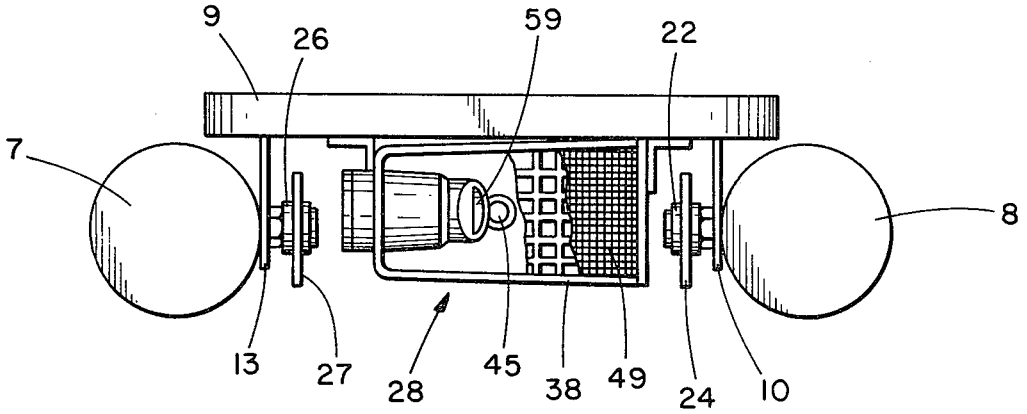
FIG. 4 is a plan view showing the central disposition of the photoelectric smoke detector between the chime bars; and with portions of the detector being removed to show the interior of the detector.
Figure 5:
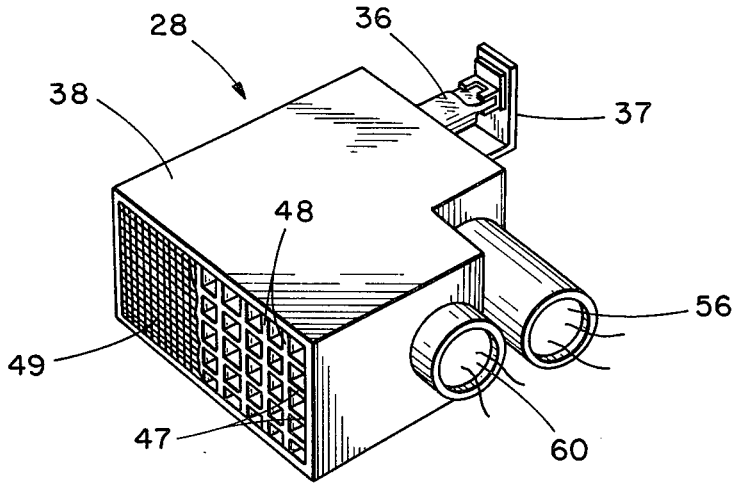
FIG. 5 is a perspective view of the photoelectric smoke detector.

The essential components of the condition-responsive door chime are supported on wall mounted base 9 (FIGS. 3 and 4). Base 9 carries a plurality of support brackets 10, 11, 12 and 13. Support brackets 10 and 11 rigidly fix tuned resonator chamber 8 to base 9, and support brackets 12 and 13 rigidly fix tuned resonator chamber 7 to base 9.

Tone-bar support posts 14, 15, 16 and 17 are rigidly bolted to brackets 10, 11, 12 and 13 by tightened nuts 18, 19, 20 and 21, respectively.

Rubber grommets 22 and 23 are carried on shank portions of support posts 14 and 15. These grommets in turn support tone bar 24 so that when the tone bar is appropriately struck it may vibrate relatively freely.

Similarly, rubber grommets 25 and 26, located on support posts 16 and 17, carry tone bar 27 so that it too may vibrate freely when struck.

Tone bars 24 and 27 and their related resonator chambers 8 and 7, respectively, are pitched to provide two distinctive tones when the tone bars are struck individually and to provide a two-note signal when struck in sequence.

Base 9 supports photoelectric smoke detector 28 (FIG. 3), a single-note striker mechanism 29, a sustained-repetitive note striker mechanism 30 (which is also capable of generating a two-note signal) and an electronic module 31, 32, 33 and 34 which incorporates components of amplifier 31, AC voltage comparator 32, gate 33 and fullwave bridge rectifier 34, all shown in the schematic circuitry of FIG. 8.

Photocell smoke detector 28 (FIGS. 3–7) is supported on base 9 (FIG. 4) in a position located between tone bars 24 and 27.

Exciter lamp 36 is supported on a metallic support bracket 37 (FIGS. 5–7) which is affixed to smoke detector housing 38. Housing 38 is preferably fabricated of a molded plastic which is opaque with a flat black finish. Housing 38 defines a compensating chamber 39 and a smoke sensing chamber 40. As is viewed in FIGS. 6 and 7, wall 41 of housing 38 is formed with an exciter lamp aperture 42. The upper end of lamp 36 envelope is tightly fitted with aperture 42 and is carried in this position by bracket 37, so that energization of the lamp filament illuminates compensating chamber 39 and smoke sensing chamber 40, generally in accordance with the triangular brokenline light-ray configuration 43.

Dividing wall 44, which separates compensating chamber 39 and smoke sensing chamber 40, is also formed with a light transmitting aperture 45 which is in the light-ray path 43. Aperture 45 has a smaller diameter than aperture 42. Accordingly, light beam 43 is narrowed as it reaches smoke detector chamber 40.

Ultimately, light-ray 43 is absorbed in the interstices of light trap 46. Trap 46 is fabricated of a plurality of long dividing walls 47 and short dividing walls 48 which intersect to form a grid of elongated rectangular holes. The dividing walls 47 and 48 are also preferably fabricated of a flat-black opaque plastic so that light absorption occurs in the elongated passageways defined by the dividing walls.

The outer rectangular openings of light trap 46 are covered by a protective screen 49 which has interstices large enough to permit particulate matter such as smoke to enter the smoke detector chamber, but small enough to prevent foreign particles, such as insects, from entering and rendering a false smoke sensing condition.

Figure 6:
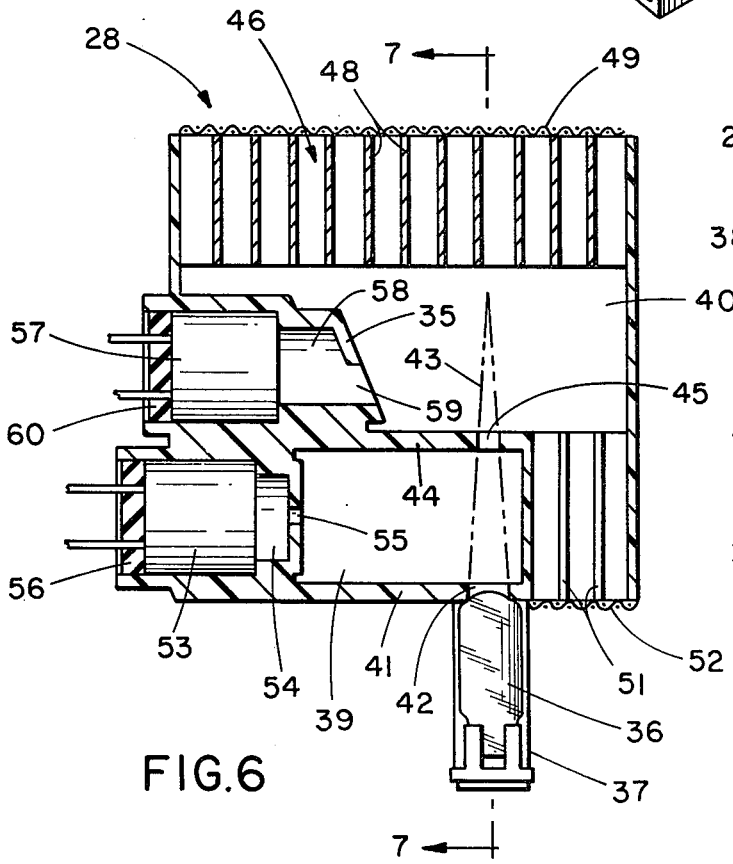
FIG. 6 is an elevation view with a portion of the smoke detector housing being in section to show the interior of the detector.
Figure 7:
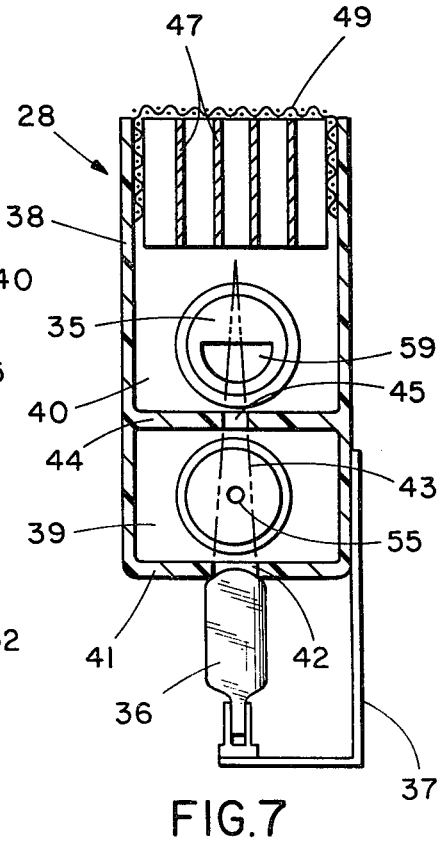
FIG. 7 is a section view taken along line 7—7 of FIG. 6, showing a different view of the interior of the smoke detector.

As is shown in FIG. 6, a second access is provided for smoke sensing chamber 40 by a plurality of spaced walls 51 and their intersecting walls (not shown) located immediately to the right of exciter lamp 36. The rectangular openings in this instance do not constitute a light trap, however, they provide additional smoke access openings into compensating chamber 40. The vertical disposition of the two sets of openings facilitates smoke flow through and into sensing chamber 40. The second set of openings is also covered by a screen 52 so that smoke can enter the smoke sensing chamber whereas foreign particles, such as insects, can not so enter.

Light compensating photoconductive cell 53 (FIG. 6) is optically coupled to compensating chamber 39 by enlarged passageway 54 and a smaller aperture 55. The light compensating photocell 53 is hermetically sealed by a rubber gasket 56 which envelopes the connection terminals of the photocell. Similarly, smoke sensing photocell 57 is optically coupled to smoke sensing chamber 40 by enlarged passageway 58 and hemispherical opening 59 located in an inclined wall 35. The inclination of wall 35 minimizes the ambient light which may strike the photoconductive surface of smoke sensing photocell 57 from light ray 43. This arrangement improves the reliability and sensitivity of smoke detector 28. Smoke sensing photocell 57 is similarly hermetically sealed within its socket opening by rubber gasket 60.

In the operating circuit configuration (FIG. 8), photoconductive compensating cell 53 and photoconductive smoke sensing photocell 57 are connected in a bridge circuit with a potentiometer 61. The bridge is normally balanced so that the bridge input to amplifier 31 is below a threshold value. Compensating photocell is included in the circuit so that changes in light intensity from exciter lamp 36, ageing of the photocells, etc., are compensated for in a conventional manner so as to minimize the probability of false alarm.

In the event that smoke enters light trap 46 or through the lower access openings formed by dividing walls 51 (FIG. 6), light ray 43 emanating from exciter lamp 36 will be scattered by the smoke particles so as to pass through the hemispherical opening 59 striking the active surface of photocell 57. Accordingly, the conductivity of smoke sensing photocell 57 is increased and the bridge circuit is unbalanced. With this circuit occurrence, an output signal appears at the output of amplifier 31, thereby causing tone bars 24 and 27 to be struck in a manner hereafter outlined in detail.

A schematic circuit diagram of condition-responsive door chime 1 is shown in FIG. 8. The door chime is equipped so that it may be actuated by two door associated pushbutton switches 62 and 63 of typical construction. The general operation of the circuit is as follows.

In the event that pushbutton switch 62 is closed, establishing a circuit connection hereafter explained in detail, single-note striker mechanism 29 is actuated and tone bar 27 is struck once rendering a single-note signal.

In the event that pushbutton 63 is closed, a circuit is completed including sustained-note striker mechanism 30. This striker mechanism strikes tone bars 27 and 24 in sequence, thereby rendering a two-note signal (but not a sustained repetitive signal).

In the event, however, that smoke is sensed by smoke detector 28, the output signal of amplifier 31 is applied to striker mechanism 30 through conductors 64, 116, contact plates 65, 66 and shuttle finger 80 associated with striker mechanism 30. Striker mechanism 30 is thus energized so that it will repetitively strike tone bars 27 and 24 rendering a loud audible sustained signal which is indicative of a smoke condition.

In order that the detailed operation of the schematic circuit of FIG. 8 may be explained in detail, it is necessary to describe the specific constructions for striker mechanisms 29 and 30. Thereafter, the formation of the several energizing circuits which result in different chime signals can be more readily understood.

Referring to FIG. 8, single-note striker mechanism 29 includes a solenoid 67 which is supported on a solenoid tube 68. Solenoid tube 68 is, of necessity, fabricated from a nonmagnetic metal, such as brass. A striker pin access opening 69 is formed at the left end of solenoid tube 68; and a rubber insert ring 70 is inserted into the right end of solenoid tube 68. Rubber cap 71 is carried on the right end of solenoid tube 68. This cap is formed with a central air flow opening 72 so that reciprocation of solenoid plunger 73 within the bore of tube 68 can effectively take place without air compression. Plunger 73 is necessarily fabricated from a magnetic material, such as iron or steel. The opposite ends of plunger 73 are supported on relatively thin flanges 74 and 75, slidably interfitting solenoid tube 68, to reduce friction.

A helical compression spring is sandwiched between flange 74 and the left end of solenoid tube 68. Accordingly, in the normally retracted position of plunger 73, the forward end of the plunger extends only partially within the bore of solenoid coil 67 which is wound upon the forward portion of solenoid tube 68.

The left end of plunger 73 carries a striker pin 77 which is preferably formed of a fibrous or plastic material.

When solenoid coil 67 is energized by the closing of pushbutton switch 62, the secondary voltage of transformer 78 is applied to solenoid coil 67. The resulting magnetic flux generated by solenoid coil 67 acts upon plunger 73 with sufficient force to compress spring 76, causing striker pin 77 to project through pin opening 69, thereby striking tone bar 27. Thereafter, compressed spring 76 returns plunger 73 forcibly to a position which withdraws striker 77 from tone bar 27. Rubber ring 70 and cap 71 cushion the return stroke of plunger 73.

Tone bar 27 cannot be struck again unless pushbutton switch 62 is opened and subsequently closed. Consequently, the closing of pushbutton switch 62 generates only a single-note signal. In the usual application of chime 1 to a residence, pushbutton switch 62 will be located at a first entrance door leading into the building.

Sustained striker mechanism 30 is in some respects similar in construction to striker mechanism 29. However, striker mechanism 30 is capable of generating several variations of note sequences by different striking programs of tone bars 27 and 24. In particular, striker mechanism 30 can create a two-note signal by initially striking tone bar 27 and shortly thereafter striking tone bar 24. Additionally, in response to the detection of smoke, striker mechanism 30 can generate a continuous alternate striking of tone bars 27 and 24, thereby creating an intense repetitive sustained signal indicative of abnormal smoke.

Striker mechanism 30 can also generate a low-frequency repetitive signal which is indicative of the malfunctioning of smoke detector 28. This low-frequency sustained signal indicates that the filament of exciter lamp 36 has burned out.

The general construction of striker mechanism 30 is shown in FIG. 8; and the detailed construction is shown in the operational sequence of FIGS. 9–12. FIG. 13 shows the disposition of the shuttle finger 80 between a pair of contact plates 65 and 66. The particular operation of shuttle finger 80 with respect to the contact plates 65 and 66 provides the sustained repetitive striking of tone bars 27 and 24, as is hereafter explained with reference to FIGS. 9–12.

Referring to FIG. 9, sustained-note striker mechanism 30 includes a solenoid tube 81 formed of brass or similar nonmagnetic material. A solenoid plunger 82 is slidably housed within tube 81. Plunger 82 is fabricated from a magnetic material, such as iron or steel, and its opposite ends are supported on relatively thin flanges 83 and 84, slidably interfitting solenoid tube 81, to reduce friction.

In the normal retracted position of plunger 82 (FIGS. 8 and 9), the forward end of plunger 82 extends partially within the bore of solenoid coil 85 which is wound upon the forward portion of solenoid tube 81.

Plunger 82 is a double-acting plunger in the sense that it strikes both the tone bars 27 and 24; accordingly, both ends of the plunger are provided with striker pins 86 and 87 which are formed of a fibrous or plastic material.

The pin 86 is pressed into a bore drilled axially into the left end of the body of plunger 82; however, pin 87 is pressed into a bore drilled axially into a nonmagnetic stem 88 which projects from the right end of double-acting plunger 82. The switching mechanism which effects the generation of a sustained repetitive signal includes a sliding shuttle sleeve 89 having a bore (not shown) loosely fitted upon stem 88. The outside diameter of sleeve 89 slidably interfits solenoid tube 81 so that longitudinal sliding motion may be had. Stem 88 is part of a lost motion coupling effected between plunger 82 and shuttle sleeve 89, as hereafter described. Sleeve 89 is fabricated from an electrical insulating material, such as a plastic or fibrous composition. The outer portion of stem 88 is formed with an annular groove (not shown) and a retainer ring 90 is locked within this groove. Shuttle sleeve 89 is free to move along stem 88 between retainer ring 90 and the abutment shoulder defined by flange 84.

Figure 10:
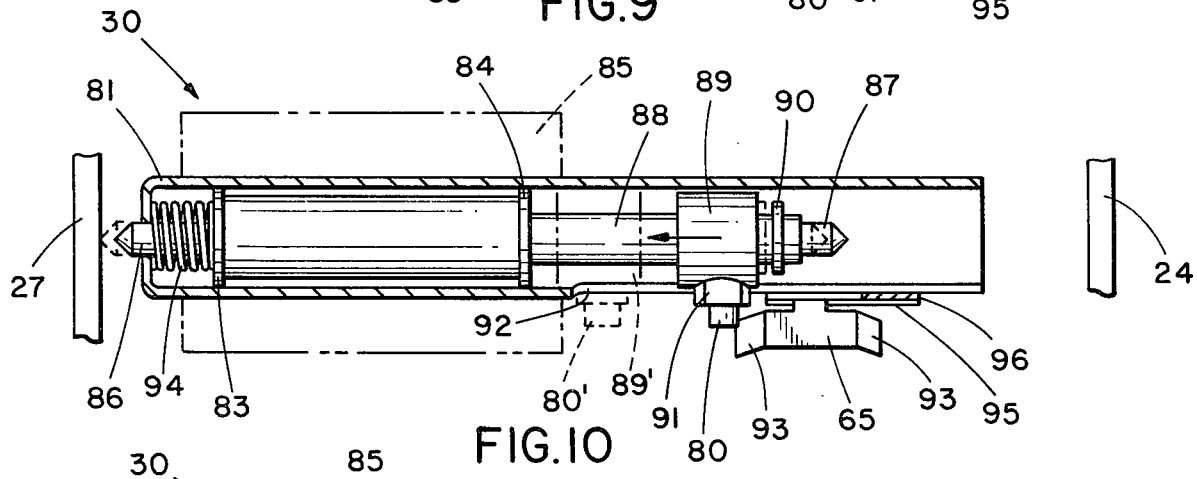

The length of stem 88 between retainer ring 90 and the shoulder of flange 84 is related to the total stroke of plunger 82 required to shift shuttle sleeve 89 alternately to the two different positions shown in FIGS. 9 and 10.

As seen in these views, the stroke of shuttle sleeve 89 is only a fraction of the total stroke of plunger 82. Thus, as plunger 82 is propelled magnetically in its power stroke (FIG. 9), it attains maximum velocity before lost motion shifts shuttle stem 89 to the open circuit position shown in FIG. 10. During the return stroke effected by spring 94, plunger 82 again reaches maximum velocity before it shifts shuttle stem 89 to a circuit closing position (FIG. 11) near the end of the return stroke. Accordingly, the lost motion connection takes advantage of the momentum of the plunger in shifting shuttle stem 89 to its two positions.

It should be understood that the stem 88 is slidably guided by shuttle sleeve 89 as stem 88 passes loosely through shuttle sleeve 89. Accordingly, during the major portion of the plunger stroke, there is no substantial friction between plunger 82 and shuttle sleeve 89.

Shuttle sleeve 89 supports and drives a reciprocating switch finger 80 consisting of a cylindrical metal stud embedded in a boss 91 formed on the periphery of sleeve 89. A longitudinal clearance slot 92 is formed in the lower portion of solenoid tube 81 to permit longitudinal motion of sleeve 89, boss 91 and switch finger 80.

Boss 91 fits loosely within elongated slot 92 and projects downwardly beyond the periphery of solenoid tube 81. Boss 91 limits rotary motion of shuttle sleeve 89 and its attached switch finger 80. Boss 91 also insulates metallic switch finger 80 from metallic solenoid tube 81.

Switch finger 80 moves longitudinally relative a pair of stationary contact plates 65 and 66 (FIG. 13) which are formed of thin flexible sheet metal.

In order to provide a camming action with respect to finger 80, the opposite ends of each contact plate 65, 66 are provided with outwardly inclined skid sections 93 (FIG. 9). These sections define converging passageways which guide the floating switch finger 80 into alignment as the finger approaches contact plates 65, 66 in its reciprocating motion. The normal spacing of contact plates 65 and 66 is slightly less than the diameter of finger 80. Accordingly, contact plates 65, 66 are sprung apart by finger 80 to provide a widening line contact with the projecting periphery of the finger as it passes longitudinally between the opposed contact plates 65, 66. Finger 80 thus completes an electrical circuit across the contact plates 65, 66. The sliding action of the finger keeps the contact surfaces clean to provide a good electrical contact even after prolonged service.

As is best shown in FIGS. 9–13, contact plates 65 and 66 are each supported on an integral metallic base 95. Each metallic base 95 is electrically insulated from metallic solenoid tube 81 by an insulation spacer plate 96.

Sustained-note striker mechanism 30 assumes the plunger position shown in FIG. 9 when solenoid coil 85 is deenergized. In this disposition of compenents, compression spring 94 pushes plunger 82 to the right and sliding shuttle sleeve 89 and finger 80 are disposed between contact plates 65 and 66 so that finger 80 completes an electrical circuit between the contact plates.

When striker mechanism 30 is appropriately connected, an electrical current passing through contact plate 65, finger 80 and contact plate 66 energizes solenoid 85, thereby causing the plunger to assume a position shown in FIG. 10. In FIG. 10, compression spring 94 is compressed and striker pin 86 is about to strike tone bar 27, as indicated by the broken-line striker tip. The broken line representation of shuttle sleeve 89' and pole 80' indicates the maximum movement to the left of these elements.

Figure 11:
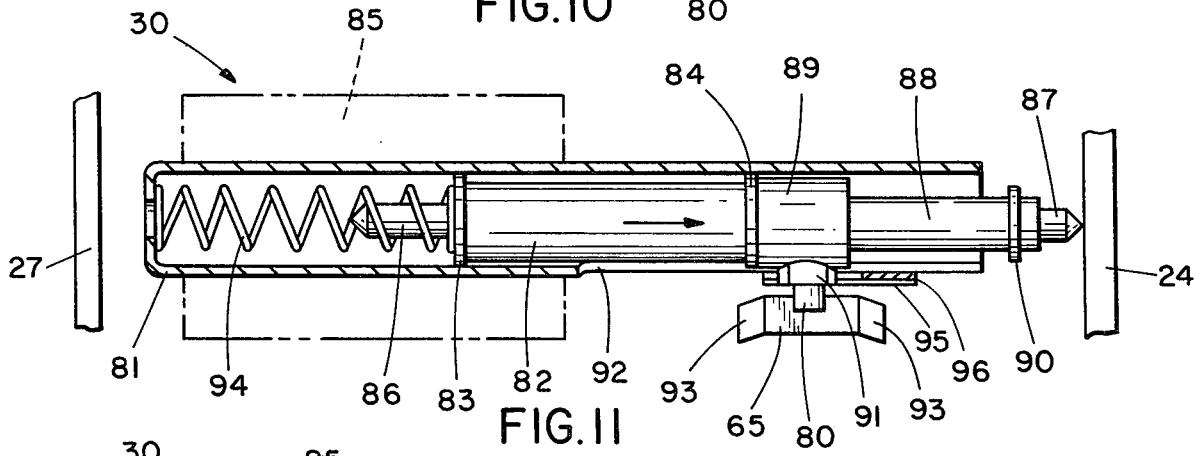

In view of the fact that the electrical energizing circuit for solenoid 85 is broken (FIG. 10), because contact finger 80 is removed from a contact position between contact plates 65 and 66, solenoid 89 is deenergized and compression spring 94 elongates as shown in FIG. 11. Flange 84 ultimately contacts the left edge of shuttle sleeve 89, driving the sleeve to a position between contact plates 65 and 66, as is indicated in FIGS. 11 and 13. However, plunger 82 has sufficient momentum to drive striker pin 87 into engagement with tone bar 28.

Figure 12:
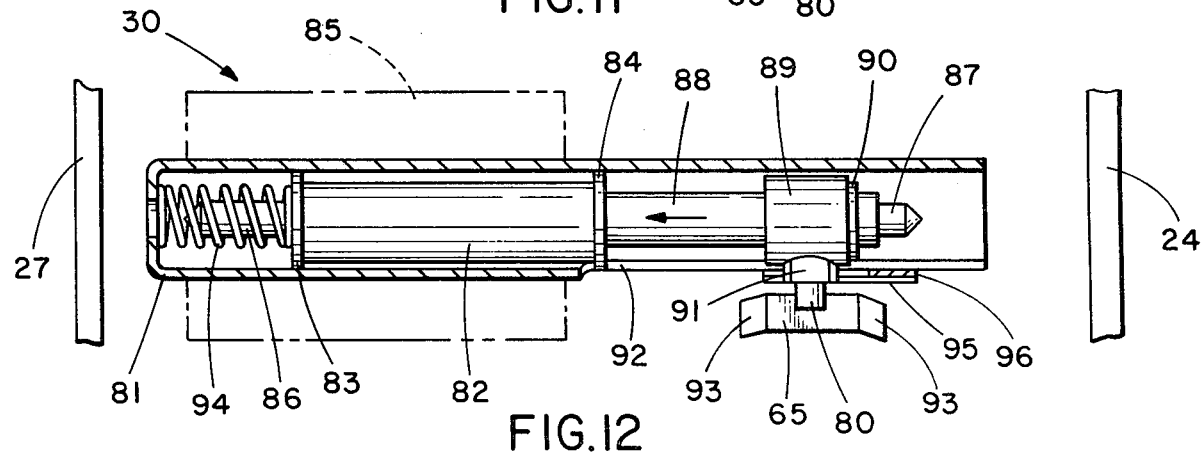

The electrical circuit energizing solenoid 85 is again completed through contact plate 65, finger 80 and contact plate 66, thus causing solenoid to again draw plunger 82 into the bore of the solenoid as shown in FIG. 12.

If the foregoing sequence of operations is continued by the making and braking of the solenoid energizing circuit through contact plate 65, finger 80 and contact plate 66, a sustained repetitive striking of tone bars 27 and 24 is attained. If, however, solenoid 85 is energized by a circuit arrangement which does not include contact plate 65, finger 80, and contact plate 66, then after the initial energization of the solenoid 85, tone bar 27 will be struck by pin 86, thereby compressing spring 94. Ultimately, the energy of the compressed spring 94 will drive plunger 82 to the right as is shown in FIG. 11, causing striker pin 87 to strike tone bar 24. However, thereafter, no further reciprocation of the plunger will occur.

Single-Note Operation of Electrical Unit

When single-note, pushbutton switch 62 is closed (FIG. 8), the secondary voltage of continuously operated step-down transformer 78 is applied to solenoid coil 67 by a circuit which includes conductors 112, 113, 97, pushbutton switch 62, conductor 98, solenoid coil 67, conductors 99, 103, and 104 back to the secondary of transformer 78. Plunger 73 is drawn into the bore of solenoid 67 in a response to the energization of the solenoid, thereby compressing spring 76 and enabling striker pin 77 to strike tone bar 17. Thereafter, plunger 73 will be driven to the right until its motion is cushioned by rubber insert ring 70 and cap 71. No further striking of tone bar 27 will occur until single-note, pushbutton switch 62 is again manually closed.

Two-Note Operation of Electrical Circuit

In the event that two-note, pushbutton switch 63 is manually closed, the secondary voltage of transformer 78 is applied to selenoid 85 through a circuit which includes conductors 112, 113, pushbutton switch 63, voltge-dropping resistor 100, conductor 101, the coil of solenoid 85, conductors 102, 103 nd 104 back to the secondary of transformer 78.

In response to the energization of solenoid coil 85, plunger 82 is drawn into the bore of solenoid coil 85 until striker pin 86 strikes tone bar 27. Thereafter, compressed spring 86 will drive plunger 82 rightwardly until striker pin 87 strikes tone bar 24. The continued closing of two-note pushbutton switch 63 will not cause further striking of either tone bar.

Circuit Operation in Response to the Detection of Smoke

In the event that smoke is detected by smoke detector 28, the following circuit operation will occur. At the outset, the secondary voltage of transformer 78 is applied to exciter lamp 36 in a circuit which includes conductors 104, 105, 106, 107, exciter lamp 36, conductor 108, voltage dropping resistor 109, conductors 110, 111 and 112 back to the secondary winding of transformer 78. The light emanating from exciter lamp 36 will be scattered and reflected in smoke chamber 40. A portion of this light will strike photoconductive cell 57, thereby altering the state of the bridge circuit which includes photoconductive cells 53, 57 and potentiometer 61. The resulting input signal applied to amplifier 31 through conductors 114 and 115 will create a signal output on conductor 64 which will be applied to contact plate 65 of striker mechanism 30 through conductor 116. The circuit is further completed from contact plate 65 through finger 80 to contact plate 66, conductor 116, conductor 101, the coil of solenoid 85 and conductors 102 and 103 back to ground. As long as a signal appears at the output of amplifier 31, a repetitive striking of tone bars 27 and 24 will occur. In view of the fact that voltage dropping resistor 100 is eliminated from the energizing circuit for solenoid coil 85 in response to smoke detection, the voltage applied to solenoid coil 85 is relatively larger than that applied when two-note pushbutton switch 63 is closed. Accordingly, a relatively loud sustained alarm signal is generated. This alarm signal should alert any occupants that a hazardous smoke condition exists.

Circuit Operation in Response to Exciter Lamp Failure

In the event that the filament of exciter lamp 36 is burned out, quite obviously, smoke detector 28 is incapable of detecting smoke. Accordingly, an optional circuit involving AC voltge comparator 32, gate 33 is included in a preferred circuit design. Its operation is as follows:

When the filament of exciter lamp 36 burns out, the voltage appearing across voltage dropping resistor 109 is increased to the full secondary voltage of transformer 78. This voltage exceeds the threshold voltage for AC voltage comparator 32. Accordingly, an output signal appears at conductor 117 to which is applied to gate 33. Gate 33 is designed so that it performs as a gate for one second with a succeeding rejection period of about two seconds. Accordingly, output pulses of the order of one second on and two seconds off appears at the output conductor 118 for gate 33. This signal is applied to conductor 116, contact plate 65, finger 80, contact plate 66, conductors 116, 101, coil of solenoid 85 and conductors 102 and 103 back to ground. This periodic energization of solenoid 85 enables striker mechanism 30 to strike tone bars 27 and 24 to generate a sequence of two-note signals each separated by intervals of quiet. The trouble signal is thus distinguishable from the alarm signal.

It should be understood that changes can be made in the foregoing structure without departing from the scope of the invention. For example, the chime may be an electrically energized chime of a clock or other device. Additionally, the chime need not necessarily provide door chime annunciation in the form of single-note and two-note signalling. An essential requirement is that the device incorporate the alarm of this invention and have at least a pair of tone bars which may be repetitively struck to provide a sustained, intense alarm signal.

What is claimed is:

1. In a door chime having a pair of spaced tone bars and an associated tone bar striker mechanism with the striker mechanism being capable of single-note two-note, and sustained-repetitive note striking of the tone bars, and a cover having access openings enabling particulate products of combustion to pass therethrough, the improvement comprising a detector for the particulate products of combustion located within the door chime and at least substantially obscured by the cover, and means electrically interconnecting the tone bar striker mechanism with the detector to actuate the striker mechanism to a state of sustained-repetitive two-note striking of the tone bars in response to the detection of the particulate products of combustion by the detector.

2. The combination of claim 1 in which the two-note and sustained-repetitive notes are generated by a single solenoid actuated reciprocating plunger striker, and comprising means for varying a characteristic of the electrical energization of the solenoid to enhance the sound level generated by the striking of the tone bars in response to the detection of the particulate products of combustion as compared to the sound level generated by the single-note and two-note striking of the two bars as a door chime.

3. The combination of claim 2, comprising means connected to the tone bar striker mechanism to generate a fourth characteristic note tone bar striking sequence in response to the malfunctioning of the particulate products of combustion detector.

4. The combination of claim 3 in which the detector is a photocell detector having an exciter light source which fails to emit light to thereby generate the fourth characteristic note sequence.

5. The combination of claim 3 comprising a common alternating current transformer for supplying electrical current for both the particulate products of combustion detector and the tone bar striker mechanism.

6. The combination of claim 5 in which the power supply is a low-voltage, door-chime transformer which is continuously energized.

7. The combination of claim 3 comprising a first switch associated with a first door and so connected to actuate the tone bar striker mechanism to a single-note signal.

8. The combination of claim 7 comprising a second switch associated with a second-door and so connected to actuate the tone bar to a two-note signal.

9. The combination of claim 1, comprising means connected to the tone bar striker mechanism to generate a fourth characteristic note tone bar striking sequence in response to the malfunctioning of the particulate products of combustion detector.

* * * * *